US010576997B2

(12) United States Patent
Martin et al.

(10) Patent No.: US 10,576,997 B2
(45) Date of Patent: Mar. 3, 2020

(54) INSTALLATION AND METHOD OF TRANSPORT BY OVERHEAD CABLE

(71) Applicant: POMA, Voreppe (FR)

(72) Inventors: Sébastien Martin, Voreppe (FR); Clémence Seve, Saint Laurent du Pont (FR)

(73) Assignee: POMA, Voreppe (FR)

( * ) Notice: Subject to any disclaimer, the term of this patent is extended or adjusted under 35 U.S.C. 154(b) by 231 days.

(21) Appl. No.: 15/493,295

(22) Filed: Apr. 21, 2017

(65) Prior Publication Data

US 2017/0305441 A1 Oct. 26, 2017

(30) Foreign Application Priority Data

Apr. 21, 2016 (FR) ..... 16 53542

(51) Int. Cl.
*B61B 12/00* (2006.01)
*B61B 11/00* (2006.01)

(52) U.S. Cl.
CPC ..... *B61B 12/002* (2013.01); *B61B 11/00* (2013.01)

(58) Field of Classification Search
CPC ..... B61B 11/00; B61B 12/002; B61B 12/122; B61B 12/00; B61B 12/02; B61D 19/02; Y02T 30/30; E05Y 2900/51
See application file for complete search history.

(56) References Cited

U.S. PATENT DOCUMENTS

| | | | | |
|---|---|---|---|---|
| 6,494,145 | B2 * | 12/2002 | Kernan | B61B 12/002 104/28 |
| 8,051,778 | B2 * | 11/2011 | Osterle | B61B 12/002 105/149.1 |
| 2007/0095244 | A1 * | 5/2007 | Sutter | B61B 12/002 104/112 |
| 2010/0083867 | A1 | 4/2010 | Switzeny | |
| 2018/0251137 | A1 * | 9/2018 | Sutterluety | B61B 11/00 |

FOREIGN PATENT DOCUMENTS

| | | |
|---|---|---|
| AT | 385961 B | 6/1988 |
| CH | 543991 A | 11/1973 |
| DE | 20 2013 101506 U1 | 7/2014 |
| EP | 2172379 A1 | 4/2010 |
| EP | 2792565 A1 | 10/2014 |

* cited by examiner

*Primary Examiner* — Mark T Le
(74) *Attorney, Agent, or Firm* — Oliff PLC

(57) ABSTRACT

Installation of transport by overhead cable including at least one chair configured to be suspended on the overhead cable and including a pivoting seat surface, a back rest and a pivoting mechanism to modify the inclination of the seat surface with respect to the back rest, the installation including an actuator configured to cooperate with the pivoting mechanism so as to control pivoting of the seat surface, the actuator being mounted movable between a raised position in which the actuator controls raising of the seat surface in the direction of the back rest and a lowered position in which the actuator controls lowering of the seat surface.

9 Claims, 4 Drawing Sheets

INSTALLATION AND METHOD OF TRANSPORT BY OVERHEAD CABLE

BACKGROUND OF THE INVENTION

The invention relates to transport by overhead cable, and more particularly to chair lifts.

STATE OF THE ART

Chair lifts are overhead cable transport installations comprising chairs suspended on the cable. These chair lifts are generally used in the mountains as they are particularly suitable for winter sports, in particular skiing. In particular a large number of chairs are suspended on the cable in order to ensure a sufficiently high passenger throughput capacity. However, these chairs are in the open air, and when it snows, the seat surfaces of the chairs are covered with snow, which weighs the chairs down and can soak the seat surfaces thus making them uncomfortable when the passengers sit on them.

Certain chair lifts have chairs equipped with seat surfaces mounted pivoting in order to raise the seat surfaces to protect them from the snow and to reduce the surface retaining the piles of snow. Swiss Patent CH543991 can for example be cited which discloses a chair lift in which the back rests of the chairs are able to be folded in the direction of the seat surfaces. Austrian Patent AT385961 can also be cited which discloses a chair lift in which the chairs have pivoting back rests and seat surfaces to close or open the chairs. However, the user has to close the chairs by pivoting the seat surfaces and back rests at the end of each use, and opening them at the beginning of use, which may be tedious.

American Patent application US2010/0083867 discloses a chair lift having chairs equipped with seat surfaces which incline slightly towards the rear of the chair so that the passengers are propped up against the back rest to limit the risks of accidents on line, i.e. to prevent as far as possible the passengers from falling from the chair after they have left the departure terminal. Furthermore, the chairs are provided with a guide sheave that inclines the seat surface of the chair when the sheave is moved upwards by means of a guide rail mounted in a specific area of the terminal. But this guide rail is only configured to slightly incline the seat surfaces of the chairs in order to protect the passengers. In addition, the seat surfaces remain accessible to the passengers to enable them to sit on the chair, and can therefore be covered with snow. It therefore does not enable the seat surfaces to be protected from abundant snowfalls.

European Patent application EP2792565 and the German utility model DE202013101506 disclose a chair lift comprising a chair having a back rest and a seat surface adjustable between a seated position and a rest position in which the seat surface is parallel to the back rest, and a movable actuating device between a folded position to move the seat surface to the rest position and a horizontal position where it does not cooperate with the chair.

A requirement therefore exists to protect the chairs from inclement weather conditions in automated manner.

OBJECT OF THE INVENTION

One object of the invention consists in palliating these shortcomings, and more particularly in providing means for modifying the inclination of the seat surfaces of the chairs of an overhead cable transport installation according to requirements in automated manner.

According to one feature of the invention, an installation of transport by overhead cable is proposed comprising at least one chair configured to be suspended on the overhead cable and comprising a pivoting seat surface, a back rest and a pivoting mechanism to modify the inclination of the seat surface with respect to the back rest, the installation comprising at least one operating means, such an actuator, configured to cooperate with the pivoting mechanism so as to control pivoting of the seat surface.

Said at least one operating means is mounted movable between a raised position in which said at least one operating means controls raising of the seat surface in the direction of the back rest and a lowered position in which said at least one operating means controls lowering of the seat surface.

An installation is thus provided for which the seat surfaces of the chairs can be raised automatically, which enables the seat surfaces to be protected from inclement weather to improve passenger comfort and lighten the installation. Advantageously, an operating means also enables the installation to be used in normal conditions, i.e. in which the seat surfaces are lowered so that the passengers can sit down. The operating means is particularly suitable for raising and lowering the seat surfaces of the chairs in automated manner. The user is thus provided with the possibility of raising all the seat surfaces at the end of the day and of lowering them all at the beginning of the day, from a single location of the installation, i.e. from a single operating means. The operating means is easy to use and requires a minimum of mechanical parts.

The pivoting mechanism can comprise a transmission element connected to the seat surface and mounted movable between a first position in which the transmission element raises the seat surface in the direction of the back rest and a second position in which the transmission element lowers the seat surface.

According to one embodiment, the pivoting mechanism comprises a transmission cable connecting the transmission element with the seat surface.

According to another embodiment, the pivoting mechanism comprises a motor connecting the transmission element with the seat surface.

According to one embodiment, said at least one operating means comprises a cam provided with two surfaces of opposite inclinations so that in the raised position a first surface moves the transmission element to the first position, and in the lowered position a second surface moves the transmission element to the second position, the cam being mounted movable in translation between the raised and lowered positions.

According to another embodiment, said at least one operating means comprises a rail provided with two opposite slopes so that in the raised position a first slope moves the transmission element to the first position and in the lowered position a second slope moves the transmission element to the second position, the rail being movable in rotation between the raised and lowered positions.

The installation can comprise a first terminal for disembarking the passengers comprising a first operating means located in an exit region of the chairs from the first terminal and occupying a raised position, and a second passenger embarking terminal comprising a second operating means located in an entry region of the chairs into the second terminal and occupying a lowered position.

Build-up of snow on the seat surfaces of the chairs running between the two terminals and not carrying any passengers, i.e. the chairs which are returning to the departure terminal, can thus be prevented.

According to another feature of the invention, a method of transport by overhead cable is proposed comprising an installation having at least one chair configured to be suspended on the overhead cable and comprising a pivoting seat surface and a back rest.

The method comprises a use of at least one operating means, such an actuator, mounted movable to occupy a raised position in which said at least one operating means controls raising of the seat surface in the direction of the back rest and to occupy a lowered position in which said at least one operating means controls lowering of the seat surface.

The installation can comprise a first passenger disembarking terminal provided with an exit region of the chairs from the first terminal and with a first operating means, and a second passenger embarking terminal provided with an entry region of the chairs into the second terminal and with a second operating means, and the seat surface is raised in the direction of the back rest by means of the first operating means when said at least one chair is running in the exit region and the seat surface is lowered by means of the second operating means when said at least one chair is running in the entry region.

BRIEF DESCRIPTION OF THE DRAWINGS

Other advantages and features will become more clearly apparent from the following description of particular embodiments and implementation modes of the invention given for non-restrictive example purposes only, and represented in the appended drawings, in which.

DETAILED DESCRIPTION

Figure 1:
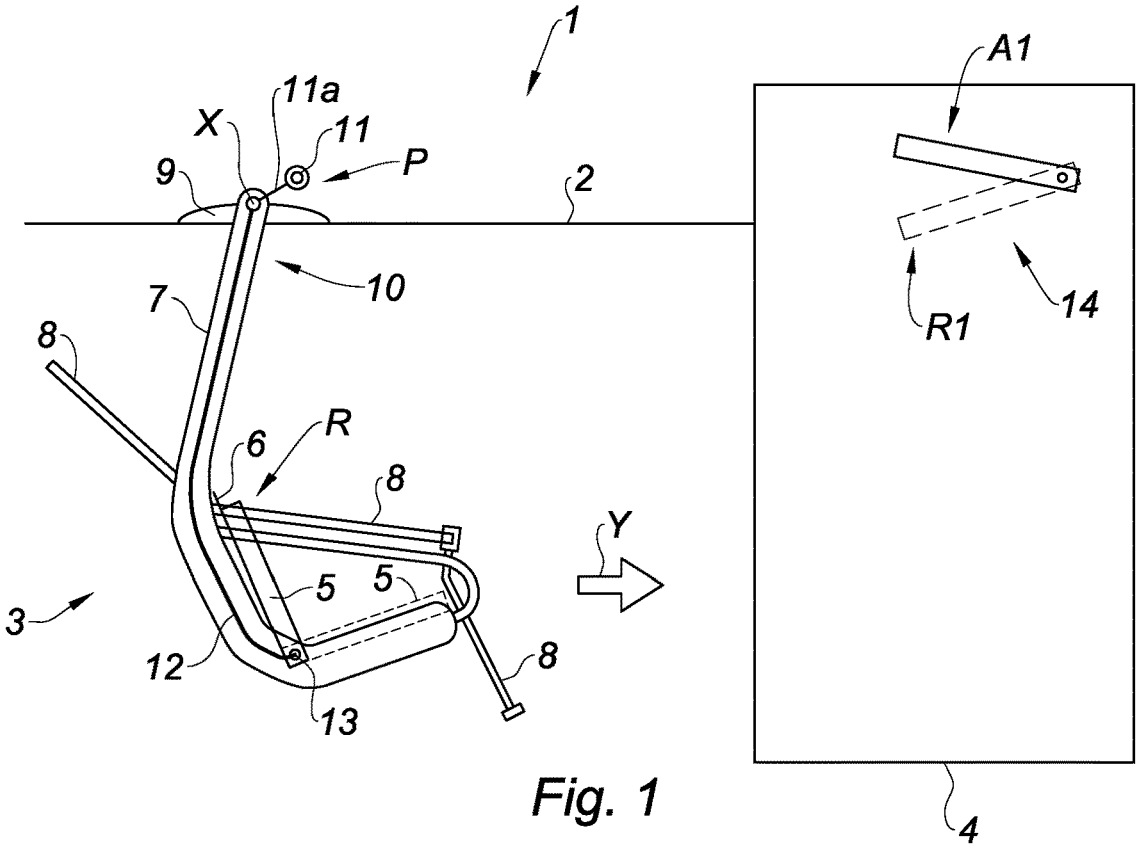
FIG. 1 schematically illustrates a perspective side view of an embodiment of a cable transport installation according to the invention where the operating means is in the lowered position.
Figure 7:
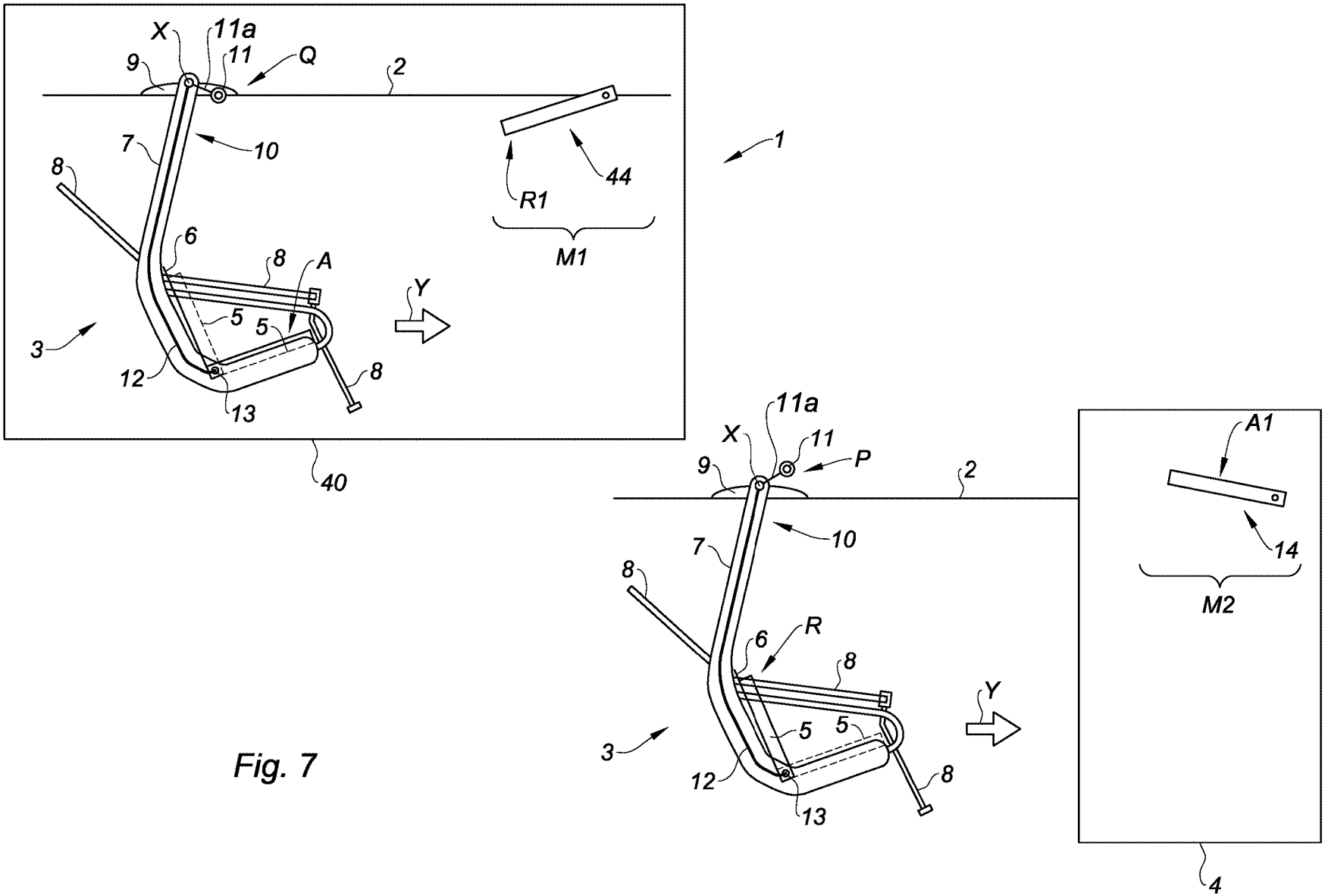
FIGS. 7 to 10 schematically illustrate other embodiments of the cable transport installation.

In FIG. 1, an embodiment of a transport installation 1 by overhead cable 2 has been represented. The installation 1 comprises at least one chair 3 configured to be suspended and hauled by the cable 2 in order to transport passengers. The installation 1 is also called chair lift. The chair lift 1 generally comprises several chairs 3, and the cable 2 is an overhead cable, i.e. the chairs 3 are suspended above the ground. A single chair 3 has been represented in FIGS. 1 and 2 for reasons of simplification. Furthermore, the cable 2 is preferably both a hauling and a carrier cable. The installation 1 generally comprises a terminal 4 for embarking and a terminal 40, as illustrated in FIG. 7, for disembarking the passengers. At least one chair 3, and preferably each chair 3, comprises at least one seat surface 5, several seat surfaces 5 situated next to one another, designed to seat a passenger. In general manner, a chair 3 comprises as many back rests 6 as seat surfaces 5, and a chair structure 7 on which the back rests 6 and seat surfaces 5 are mounted. The chair 3 comprises a hoop guard 8 mounted pivoting on the chair structure 7 for protection of the passengers seated on the chair 3. Each chair 3 further comprises a clamp 9 to suspend it on the cable 2. The clamps 9 can be fixed, and in this case the chairs 3 are suspended in permanent manner onto the cable 2. Preferentially, the clamps 9 are detachable, and in this case the chairs 3 are attached in removable manner to the cable 2.

Figure 2:
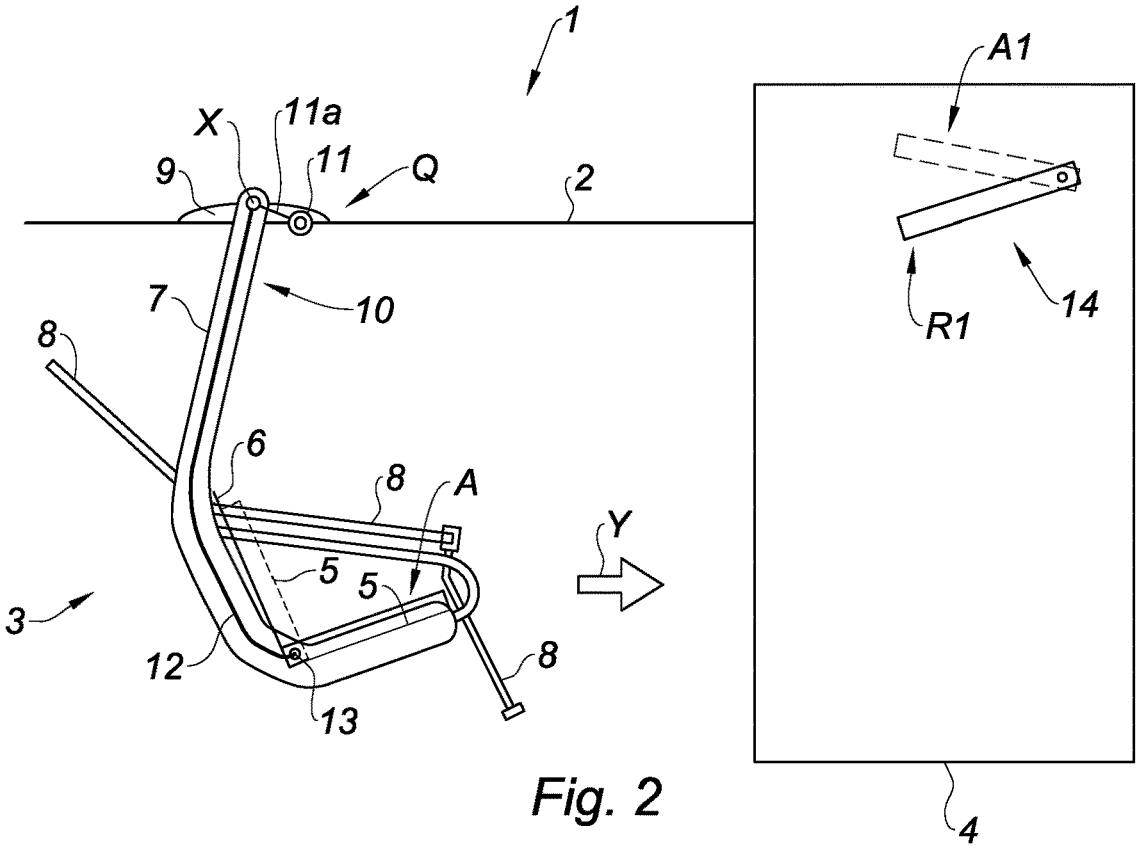
FIG. 2 schematically illustrates a perspective side view of an embodiment of a cable transport installation according to the invention where the operating means is in the raised position.

A chair 3 further comprises at least one seat surface 5 mounted pivoting on the chair structure 7 between a raised position R, as illustrated in FIG. 1, in which the seat surface 5 is situated against the back rest 6, and a lowered position A, as illustrated in FIG. 2, in which the seat surface 5 is away from the back rest 6 and enables a passenger to sit on the seat surface 5. Preferentially, all the seat surfaces 5 of a chair 3 are mounted pivoting. For example, all the chairs 3 of the installation 1 each have their seat surfaces 5 mounted pivoting. Furthermore, each chair 3 comprises a pivoting mechanism 10 configured to modify the inclination of at least one seat surface 5 with respect to the back rest 6, and more particularly the inclination of all the seat surfaces 5 of the chair 3. More particularly, the pivoting mechanism 10 comprises a transmission element 11 connected to the pivoting seat surface 5. The transmission element 11 is further mounted movable on the chair structure 7 between a first position P in which the transmission element 11 raises the seat surface 5 in the direction of the back rest 6, and a second position Q in which the transmission element 11 lowers the seat surface 5. What is meant here by raises is the fact that the seat surface 5 is directed upwards, in particular towards the back rest 6, until it is in contact with the back rest 6 or leaves a narrow space between the back rest 6 and the seat surface 5 so as to reduce the volume comprised between the seat surface 5 and the back rest 6 to limit build-up of snow on the seat surface 5. More particularly, in the raised position R of the seat surface 5, the distance separating the back rest 6 from a front edge of the seat surface 5 is less than half the length of the seat surface 5. In other words, in the raised position R, a passenger cannot sit on the seat surface 5. On the contrary, what is meant by lowers is the fact that the seat surface 5 is directed downwards, in other words the seat surface 5 is located away from the back rest 6 to again occupy its initial position, called normal operating position.

Figure 9:
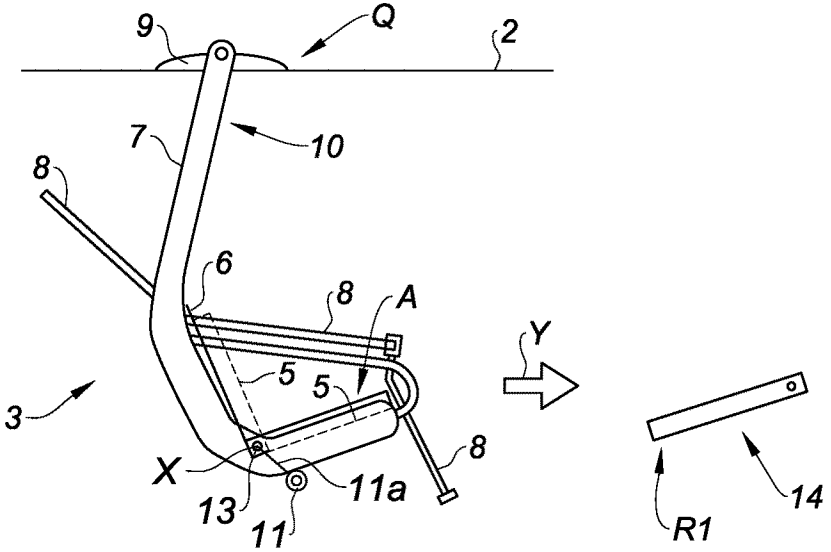
Figure 8:
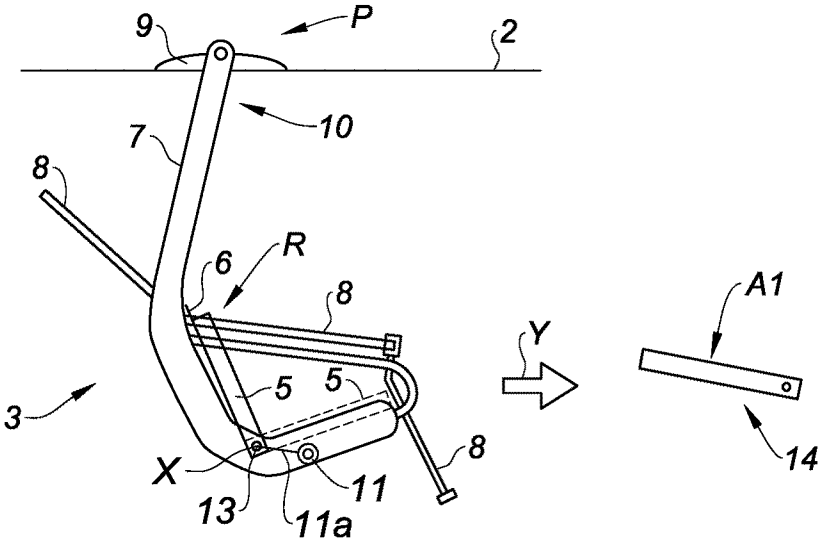
Figure 10:
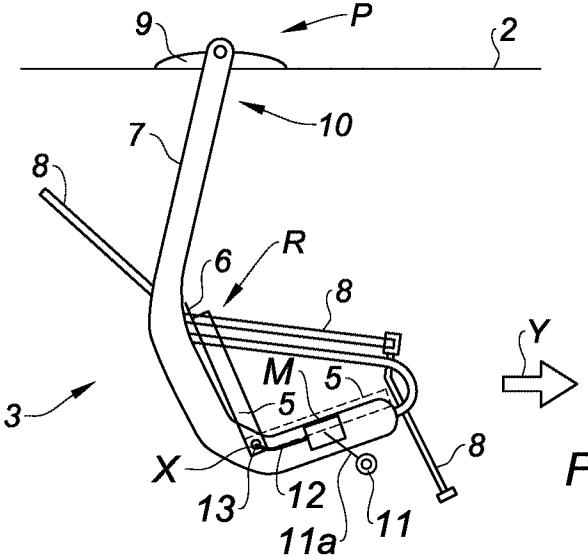

For example, the transmission element 11 is mounted rotating on the structure 7 around an axis X perpendicular to the direction Y of movement of the chair 3. The transmission element 11 can be a sheave mounted fixed, or movable, on an arm mounted movable on the chair structure 7. In general manner, the pivoting seat surface 5 is mounted on the chair structure 7 by a pivot link 13. For example, the seat surface 5 comprises a pivoting shaft mounted rotating around an axis perpendicular to the direction Y. Pivoting of the seat surface 5 can be achieved in different manners. For example, the pivoting mechanism 10 comprises a drive system, not represented for the sake of simplification, which causes pivoting of the seat surface 5 with respect to the back rest 6 according to the position of the transmission element 11. The drive system can comprise a gear system formed by a set of cog-wheels. As a variant, the drive system comprises a set of smooth wheels and belts, or a combination of smooth wheels and cog-wheels. In particular, the drive system is connected to the pivoting shaft to pivot the seat surface 5. The transmission element 11 can be connected to the drive system by means of an arm 11*a* mounted rotating around the axis X, as illustrated in FIGS. 8 and 9. In this case, the transmission element 11 is situated at the level of the seat surface 5 to reduce the overall dimensions of the chair 3. As a variant, the pivoting mechanism 10 comprises a transmission cable 12 connecting the transmission element 11 with the pivoting seat surface 5. In particular, the transmission cable 12 is connected to the drive system described above. In this case, the transmission element 11 can be located away from the seat surface 5. In general manner, the transmission cable 12 is flexible. As a variant, the transmission cable 12 can be replaced by several rods articulated on one another. The transmission cable 12 enables the drive system to be actuated to cause raising and/or lowering of the seat surface 5. In general manner, the pivoting mechanism 10 is reversible. According to yet another embodiment, illustrated in FIG. 10, the pivoting mechanism 10 comprises a motor M connecting the transmission element 11 with the seat surface 5. The motor M is configured to animate the pivoting shaft in rotation to pivot the seat surface 5 according to the position of the transmission element 11.

In FIG. 1, the seat surface 5 has been represented by a broken line in a lowered initial position and by an unbroken line in a raised position R. In opposite manner, in FIG. 2, the seat surface 5 has been represented by a broken line in the raised position and by an unbroken line in the initial lowered position A. The seat surface 5 pivots from one position to the other, and vice versa, by means of the pivoting mechanism 10.

The installation 1 comprises at least one operating means 14, 44, such an actuator, configured to cooperate with the pivoting mechanism 10 so as to control pivoting of the seat surface 5. For example, the installation 1 can comprise a single operating means 14 situated in one of the terminals 4, 40. The operating means 14 may be situated outside the terminals, for example it can be mounted on a pillar located near a terminal 4. As a variant, as illustrated in FIG. 7, each terminal 4, 40 comprises an operating means 14, 44. In particular, the operating means 14 is mounted movable between a raised position R1, as illustrated by an unbroken line in FIGS. 2, 3 and 5, and a lowered position A1, as illustrated by an unbroken line in FIGS. 1, 4 and 6. In the raised position R1, illustrated in FIG. 2, the operating means 14 is configured to control raising of the seat surface 5 in the direction of the back rest 6. More particularly, in the raised position R1, the operating means 14 cooperates with the pivoting mechanism 10 when the chair passes in front of the operating means 14. In other words, when the chair 3 passes in front of the operating means 14, the transmission element 11 comes into contact with the operating means 14 and the latter moves the transmission element 11 to the first position P. The change of position of the transmission element 11 controls pivoting of the seat surface 5. When the pivoting mechanism 10 comprises a transmission cable 12, the transmission element 11 exerts a first tension on the transmission cable 12, which makes the seat surface 5 pivot to the raised position R. When the pivoting mechanism 10 comprises a motor M, the transmission element 11 controls the motor M to animate the pivoting shaft in a first direction of rotation, which makes the seat surface 5 rotate to the raised position R. All the seat surfaces 5 of the chairs 3 of the installation can thus be raised by positioning the operating means 14 in the raised position R1.

The operating means 14 is further configured to occupy a lowered position A1 in which the operating means 14 controls lowering of the seat surface 5. In the lowered position A1, illustrated in FIG. 1, the operating means 14 cooperates with the pivoting mechanism 10 when the chair 3 passes in front of the operating means 14. In other words, when the chair 3 passes in front of the operating means 14, the transmission element 11 comes into contact with the operating means 14 and the latter moves the transmission element 11 to the second position Q. The change of position of the transmission element 11 makes the seat surface 5 pivot to the lowered position A. When the pivoting mechanism 10 comprises a transmission cable 12, the transmission element 11 exerts a second tension, opposite to the first tension, on the transmission cable 12, which makes the seat surface 5 pivot to the lowered position A. When the pivoting mechanism 10 comprises a motor M, the transmission element 11 controls the motor M to animate the pivoting shaft in a second direction of rotation, opposite to the first direction of rotation, which makes the seat surface 5 pivot to the lowered position A. All the seat surfaces 5 of the chairs 3 can thus be lowered to replace the seat surfaces 5 in the normal operating condition. In general manner, the position of the operating means 14 can be modified by a lever actuating a mechanical system or by means of an actuator controlling an electric, pneumatic or hydraulic motor.

After the seat surface 5 of a chair 3 has been lowered, the operating means 14 which remains in their lowered position A1 no longer cooperates with the pivoting mechanism 10 of the chair 3 when the chair 3 passes in front of the operating means 14 again. In this case, the seat surface 5 keeps its lowered position A and no longer pivots. The installation 1 can thus be operated under normal conditions to allow embarking on and/or disembarking of the passengers from the chairs 3.

Figure 4:
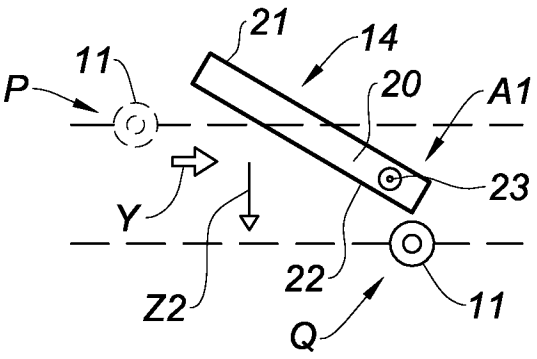
FIGS. 3 and 4 schematically illustrate an embodiment of the operating means respectively occupying a raised position and a lowered position.
Figure 3:
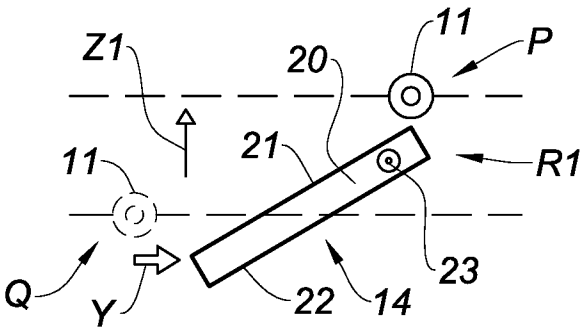

An embodiment of the operating means 14 has been represented in FIGS. 3 and 4. In this embodiment, the operating means 14 comprises a rail 20 provided with a first slope 21 located on a first surface of the rail 20, and with a second slope 22, called opposite slope, located on a second surface of the rail 20 opposite the first surface. The rail 20 is mounted movable in rotation around a main axis 23, between the raised position R1, illustrated in FIG. 3 and the lowered position A1, illustrated in FIG. 4. Under normal operating conditions of the installation, the operating means 14 is in the lowered position A1 and the seat surfaces 5 pivot to their lowered position A, or remain in their lowered position A if they have been previously lowered. When the seat surfaces 5 of the chairs 3 are to be raised, the operating means 14 is placed in the raised position R1 in which the first slope 21 cooperates with the transmission element 11 to move the latter to the first position P. Indeed, as illustrated in FIG. 3, the chairs 3 move in the running direction Y and, for each chair of the installation 1, the transmission element 11 translates in a direction Z1 perpendicular to the direction Y in contact with the first slope 21 of the rail 20. On the contrary, the operating means 14 is positioned in the lowered position A1 to lower the seat surfaces 5 of the chairs 3. In this case, the transmission element 11 comes into contact with the second slope 22 of the rail 20, when the chair 3 is running in the direction Y, and it follows the second slope 22, translating in the direction Z2 until it occupies the second position Q. The position A1, R1 of the rail 20 modifies the position P, Q of the transmission element 11 to make the seat surfaces pivot to the desired position A, R. The position A1, R1 of the rail 20 is modified by performing a rotation of the rail 20 around the main axis 23.

Figure 6:
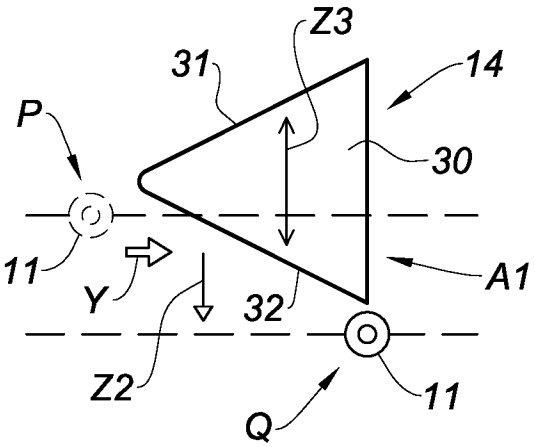
FIGS. 5 and 6 schematically illustrate another embodiment of the operating means respectively occupying a raised position and a lowered position.
Figure 5:
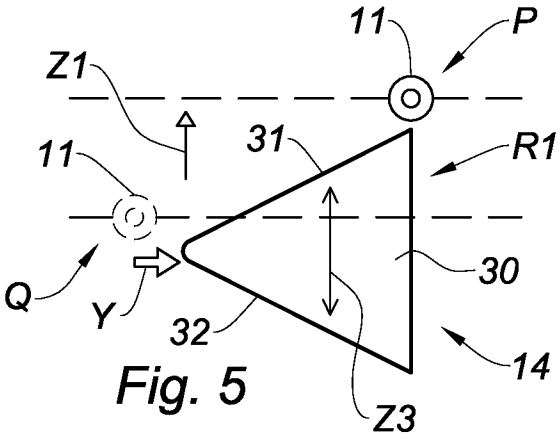

Another embodiment of the operating means 14 has been represented in FIGS. 5 and 6. In this embodiment, the operating means 14 comprises a cam 30 provided with a first surface 31 and a second surface 32 located opposite the first surface 31 and inclined with respect to the latter. The cam 30 is mounted movable between the raised position R1 and the lowered position A1. More particularly, the cam 30 is movable in translation along an axis Z3 perpendicular to the running direction Y of the chairs 3. In the raised position R1, the cam 30 presents the first surface 31 to move the translation part 11 to the first position P. In the raised position R1, the transmission element 11 comes into contact with the first surface 31 to be translated in the direction Z1. In the lowered position A1, the cam 30 presents the second surface 32 to move the translation part 11 to the second position Q. In the lowered position A1, the transmission element 11 comes into contact with the second surface 32 to be translated in the direction Z2. The position A1, R1 of the cam 30 is modified by moving it by translation along the axis Z3.

In FIG. 7, an embodiment has been represented in which each terminal 4, 40 comprises an operating means 14, 44. In this embodiment, the installation 1 comprises a first terminal 40 designed for disembarking the passengers and a second terminal 4 designed for embarking the passengers on the chairs 3. The first terminal 40 comprises an exit region M1 of the chairs 3, and a first operating means 44 located in the exit region M1 and occupying a raised position R1. In this case, when the chairs 3 are in the first terminal 40, before the exit region M1, the seat surfaces 5 are lowered and the passengers can disembark. Then, when the chairs 3 leave the first terminal 40, they pass in front of the first operating means 44 and their seat surfaces 5 are raised as the first operating means 44 is in the raised position R1. The chairs 3 which are not transporting passengers and which are directed to the second embarking terminal 4 are in this way protected from build-up of snow when running from the first terminal 40 to the second terminal 4. In particular, the first operating means 44 can be located at the entry or at the exit of the exit region M1, and it can also be located between the entry and the exit of the exit region M1. Furthermore, the second terminal 4 comprises an entry region M2 of the chairs 3, and a second operating means 14 located in the entry region M2 and occupying a lowered position A1. In this case, when the chairs 3 are located before the entry region M2, the seat surfaces 5 are raised. Then, when the chairs 3 enter the second terminal 4, they pass in front of the second operating means 14 and their seat surfaces 5 are lowered as the second operating means 14 is in the lowered position A1. The passengers can therefore embark on the chairs 3. In particular, the second operating means 14 can be located at the entry or at the exit of the entry region M2, and it can also be located between the entry and the exit of the entry region M2.

An overhead cable transport method can be implemented by the installation 1 which has just been described in the foregoing. In this method, the seat surface 5 is raised in the direction of the back rest 6 when the chairs 3 are running in the exit region M1 and the seat surface 5 is lowered when the chairs 3 are running in the entry region M2. Raising of the seat surfaces 5 is performed by moving the first operating means 44 to the raised position R1 and lowering is performed by moving the second operating means 14 to the lowered position A1.

The installation which has just been described is particularly suitable for automatically raising and lowering the seat surfaces of the chairs according to the user's requirements. In particular, the user will be able to raise all the seat surfaces at the end of operation, and will be able to simply and automatically lower all the seat surfaces again at the beginning of operation so as to be able to operate under normal conditions.

The invention claimed is:

1. An installation for transport by overhead cable, the installation comprising:

a first terminal for disembarking passengers and a second terminal for embarking passengers, at least one chair configured to be suspended on the overhead cable and comprising a pivoting seat surface, a back rest, and a pivoting mechanism configured to modify an inclination of the seat surface with respect to the back rest, the pivoting mechanism being mounted on the at least one chair, and an actuator having a first actuating surface and a second actuating surface, the actuator being situated in one of the first terminal and the second terminal and being configured to cooperate with the pivoting mechanism of the at least one chair so as to control pivoting of the seat surface, wherein the actuator is mounted so as to be movable between (i) a raised position in which the actuator controls, via the first actuating surface, raising of the seat surface in the direction of the back rest and (ii) a lowered position in which the actuator controls, via the second actuating surface, lowering of the seat surface.

2. The installation according to claim 1, wherein the pivoting mechanism comprises a transmission element connected to the seat surface and mounted so as to be movable between (i) a first position in which the transmission element raises the seat surface in the direction of the back rest and (ii) a second position in which the transmission element lowers the seat surface.

3. The installation according to claim 2, wherein the pivoting mechanism comprises a transmission cable connecting the transmission element with the seat surface.

4. The installation according to claim 2, wherein the pivoting mechanism comprises a motor connecting the transmission element with the seat surface.

5. The installation according to claim 2, wherein the actuator comprises a cam provided with the first actuating surface and the second actuating surface, the first actuating surface and the second actuating surface having opposite inclinations so that in the raised position the first actuating surface moves the transmission element to the first position, and in the lowered position the second actuating surface moves the transmission element to the second position, the cam being mounted so as to be movable in translation between the raised position and the lowered position.

6. The installation according to claim 2, wherein the actuator comprises a rail provided with the first actuating surface and the second actuating surface so that in the raised position the first actuating surface moves the transmission element to the first position, and in the lowered position the second actuating surface moves the transmission element to the second position, the rail being movable in rotation between the raised position and the lowered position.

7. The installation according to claim 1, wherein the actuator is a first actuator, and the first terminal comprises the first actuator located in an exit region of the at least one chair from the first terminal and occupying the raised position, and the second terminal comprises a second actuator located in an entry region of the at least one chair into the second terminal and occupying the lowered position.

8. A method of transport by overhead cable, the method comprising:

providing an installation having a first terminal for disembarking passengers, a second terminal for embarking passengers, at least one chair configured to be suspended on the overhead cable and comprising a pivoting seat surface and a back rest, and a pivoting mechanism configured to modify an inclination of the seat surface with respect to the back rest, the pivoting mechanism being mounted on the at least one chair, and using an actuator having a first actuating surface and a second actuating surface, the actuator being situated in one of the first terminal and the second terminal and mounted so as to be movable between (i) a raised position in which the actuator controls, via the first actuating surface, raising of the seat surface in the direction of the back rest and (ii) a lowered position in which the actuator controls, via the second actuating surface, lowering of the seat surface.

9. The method according to claim 8, wherein the actuator is a first actuator, the first terminal is provided with an exit region of the at least one chair from the first terminal and with the first actuator, and the second terminal is provided with an entry region of the at least one chair to the second terminal and with a second actuator, wherein:

the first actuator raises the seat surface in the direction of the back rest when the at least one chair is running in the exit region, and the second actuator lowers the seat surface when the at least one chair is running in the entry region.

* * * * *